US006910993B1

(12) United States Patent
Baran

(10) Patent No.: US 6,910,993 B1
(45) Date of Patent: Jun. 28, 2005

(54) DEVICE FOR USE IN TEACHING INFANTS TO WALK

(76) Inventor: Anna Baran, 32 Sheffield Dr., Marlton, NJ (US) 08053

( * ) Notice: Subject to any disclaimer, the term of this patent is extended or adjusted under 35 U.S.C. 154(b) by 0 days.

(21) Appl. No.: 10/856,332

(22) Filed: May 28, 2004

Related U.S. Application Data

(60) Provisional application No. 60/503,213, filed on Sep. 15, 2003.

(51) Int. Cl.[7] ..... A47D 13/04
(52) U.S. Cl. ..... 482/69; 434/247
(58) Field of Search ..... 434/247, 255; 482/43, 51, 69; 119/770

(56) References Cited

U.S. PATENT DOCUMENTS

| | | | | |
|---|---|---|---|---|
| 1,193,374 A | | 8/1916 | Gilliam | |
| 2,108,566 A | | 2/1938 | Sanders | |
| 4,907,972 A | | 3/1990 | Marolda | 434/255 |
| 4,922,860 A | | 5/1990 | Hutchings | 119/96 |
| 4,981,110 A | * | 1/1991 | Llewellyn | 119/770 |
| 5,120,287 A | | 6/1992 | Brown et al. | 482/69 |
| 5,325,818 A | * | 7/1994 | Leach | 119/770 |
| 5,356,355 A | | 10/1994 | Campbell | 482/43 |
| 5,435,272 A | * | 7/1995 | Epstein | 119/770 |
| 5,498,219 A | * | 3/1996 | Soufi | 482/69 |
| 5,540,188 A | * | 7/1996 | Heinrichs | 119/770 |
| 5,619,955 A | * | 4/1997 | Nelson | 119/857 |
| 5,766,114 A | * | 6/1998 | Campbell | 482/55 |
| 6,196,949 B1 | | 3/2001 | Rodarte | 482/69 |
| 6,325,023 B1 | | 12/2001 | Elnatan | 119/770 |
| 6,338,699 B1 | | 1/2002 | Veitch | 482/69 |
| 6,361,478 B1 | * | 3/2002 | Giancaspro | 482/69 |

* cited by examiner

*Primary Examiner*—Kurt Fernstrom
(74) *Attorney, Agent, or Firm*—Howson and Howson

(57) ABSTRACT

A device for use by an adult to support an infant at a comfortable walking position for both while teaching the infant how to walk.

12 Claims, 4 Drawing Sheets

DEVICE FOR USE IN TEACHING INFANTS TO WALK

CROSS-REFERENCE TO RELATED APPLICATIONS

This application claims the benefit of U.S. Provisional Application No. 60/503,213, filed Sep. 15, 2003.

FIELD OF THE INVENTION

The present invention relates to devices for use in assisting infants in learning to walk, and more particularly, the present invention relates to a device for enabling an adult to walk upright while simultaneously teaching an infant how to walk.

BACKGROUND OF THE INVENTION

In teaching an infant to walk, an adult often leans forwardly and supports the infant by manually supporting the infant underneath its armpits to enable the infant to walk in front of the adult. The adult is, therefore, thereby able to allow the infant to place weight on its feet while restraining the infant from falling. The problem with this walking training mode is that the adult is bent forwardly, and after a period of time, may experience discomfort in supporting the infant while walking in such a position.

There have been several attempts to provide devices that can be used by adults to assist in supporting an infant or small child while learning a variety of activities that include teaching balance while in an upright position such as walking. These patents include the following: U.S. Pat. Nos. 1,193,374; 2,108,566; 4,907,972; 4,922,860; 5,120,287; 5,356,355; 6,196,949; 6,325,023; 6,338,699; 6,361,478.

While the various patented devices may function satisfactorily for their intended purposes, there is a need for a device that enables an adult to stand in an upright position while supporting an infant to teach the infant to walk while supported in front of the adult.

OBJECT OF THE INVENTION

It is, therefore, an object of the present invention to provide a device of the type described that can be used comfortably by an adult, that is straightforward to manufacture, and that is readily launderable.

BRIEF DESCRIPTION OF DRAWINGS

The features of the present invention should be apparent from the following description when viewed in conjunction with the accompanying drawings, in which.

DESCRIPTION OF PREFERRED EMBODIMENT

Figure 1:
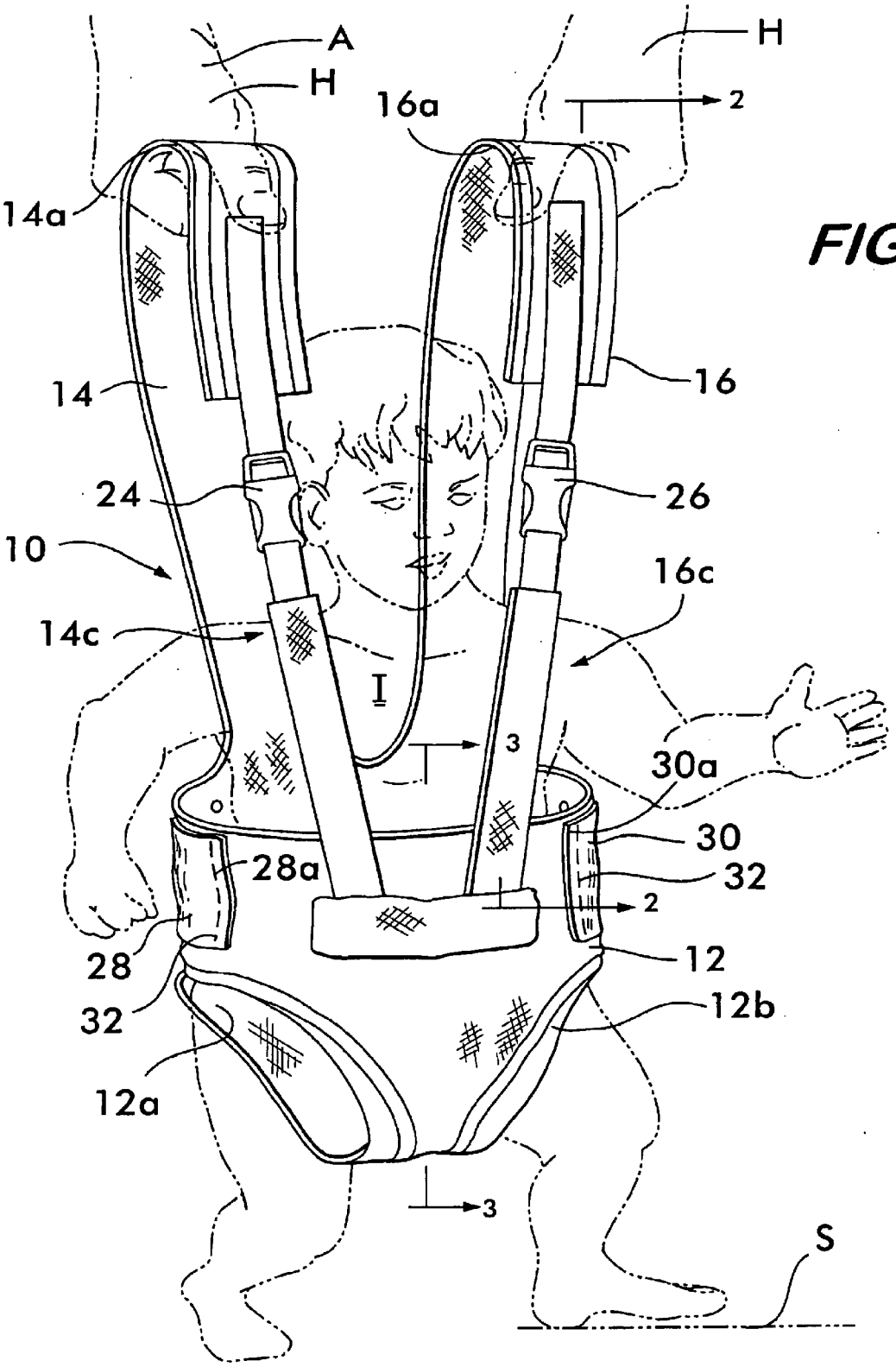
FIG. 1 is a perspective view of an infant walk-teaching device embodying the present invention.

Referring now to the drawings, FIG. 1 illustrates a device 10 for use by an adult A to walk an infant I while the adult is standing erect behind the infant. The device 10 comprises a padded harness 12 which supports the infant I from locations below and around the infant's thorax, or chest, and a pair of vertically-elongate flexible, inverted U-shape straps 14,16 extending upwardly from the harness 12 for providing a pair of bights 14*a*, 16*a* that are gripable by the adult's hands H while standing erect with both the adults' and infants' feet on a common walking surface S. The lower end of the harness 12 has a pair of leg-receiving holes 12*a* and 12*b* for receiving the infant's legs as illustrated in FIG. 1.

Figure 2:
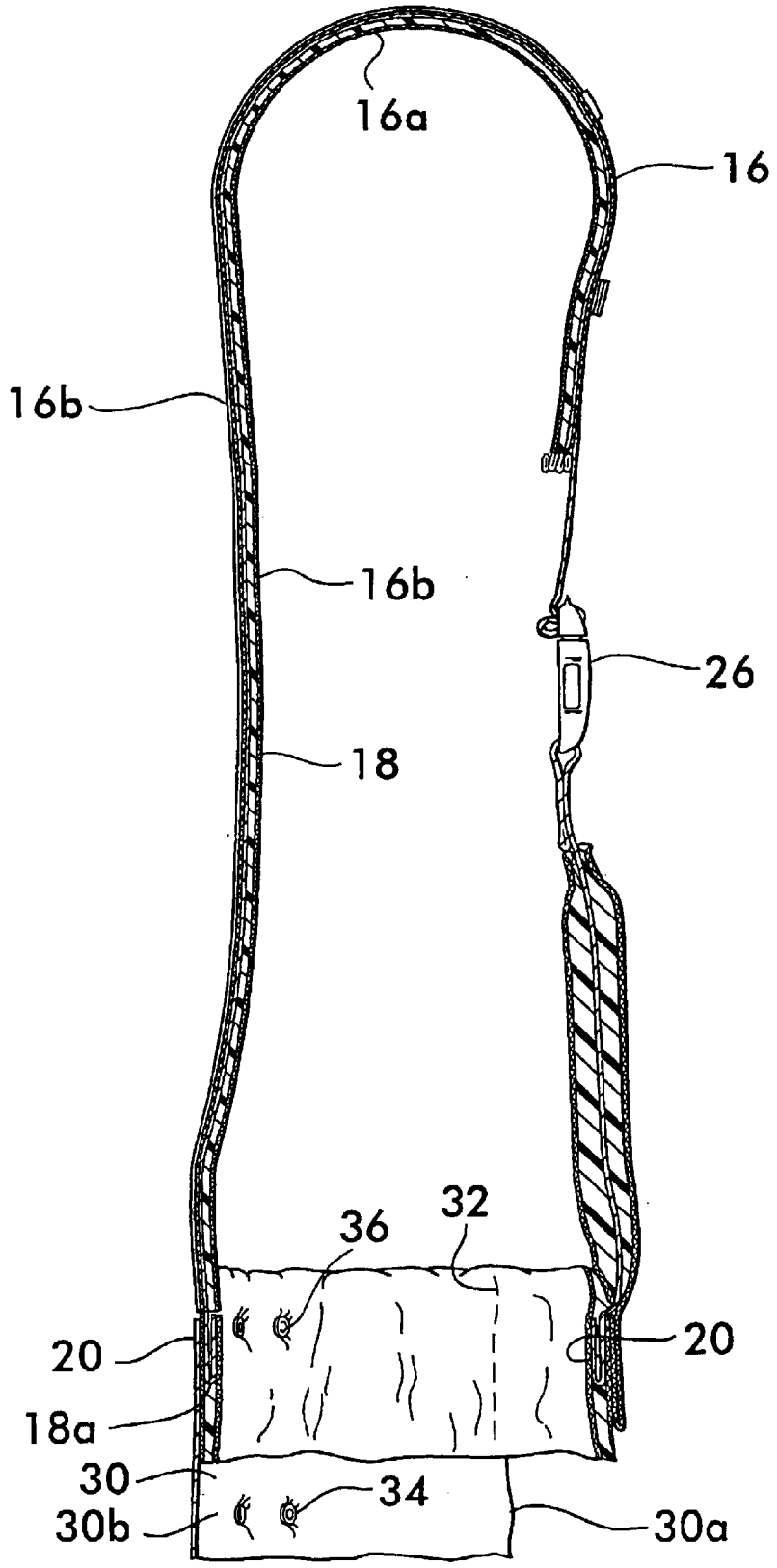
FIG. 2 is a sectional view taken on line 2—2 of FIG. 1.
Figure 3:
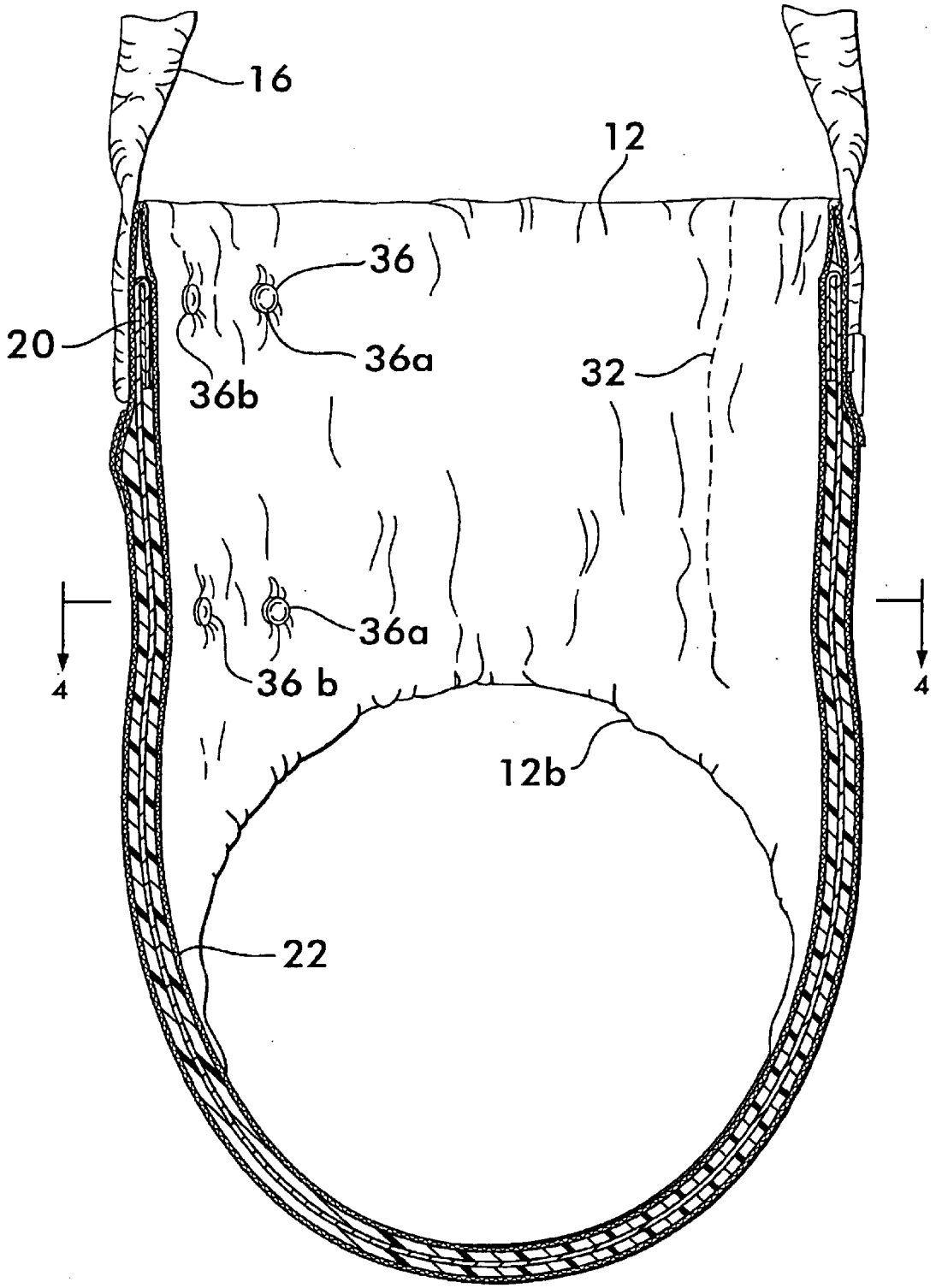
FIG. 3 is a sectional view taken on line 3—3 of FIG. 1.

The straps 14 and 16 are identical and consist essentially of a washable, flacid material 16*b* (FIG. 2) connected to the harness in such a manner that the infant's shoulders extend horizontally through the openings 14*c*, 16*c* provided by the straps below the bights 14*a*, 16*a*. Preferably, each of the straps, such as strap 16 (FIG. 2) includes a length of webbing 18 which is connected at its lower end 18*a* to a belt-like web 20 which extends around the thorax of the infant I. At least one, and preferably two, webs 22 (FIG. 3) depend in spaced relation from the belt 20 and extend through the infant's crotch from front to rear for providing support of the infant's lower torso. Each of the straps is preferably sewn inside a soft padded material in order to enhance wearing comfort for the infant I and gripping comfort for the adult A. Preferably, the padding material is of a fabric which is readily washable in a conventional home washing machine.

As best seen in FIG. 1, each of the straps is preferably provided with an adjustable, preferably soft plastic buckle 24, 26 to enable the overall lengths of the straps to be adjusted so as to enable the adult A to stand erect while the infant's feet are on the common support surface S in front of the adult. As illustrated, the straps 14, 16 extend upwardly from the harness waist a distance of about two-thirds the overall length of the device 10. A desirable overall length is close to about 3 feet before lengthwise strap adjustment to shorten the length.

Figure 4:
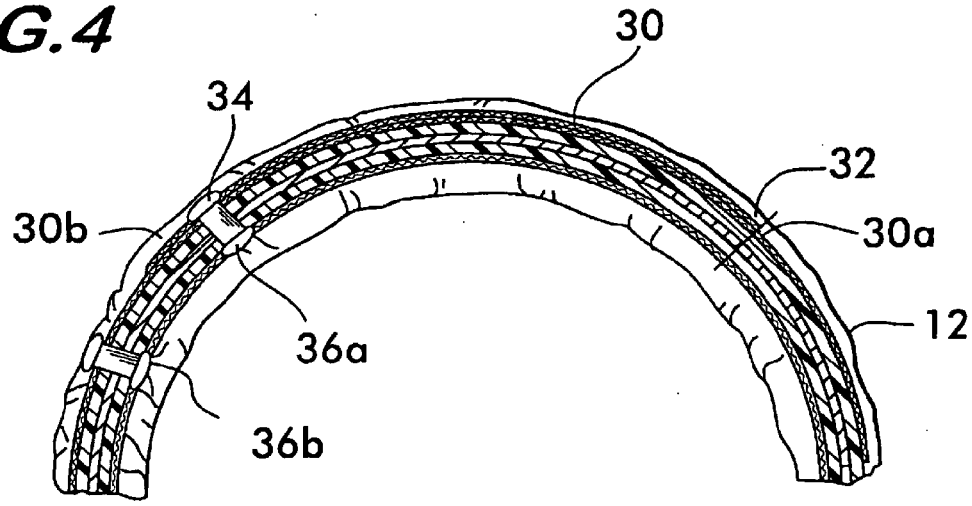
FIG. 4 is a sectional view taken on line 4—4 of FIG. 3 showing a portion of the circumference of the harness.
Figure 5:
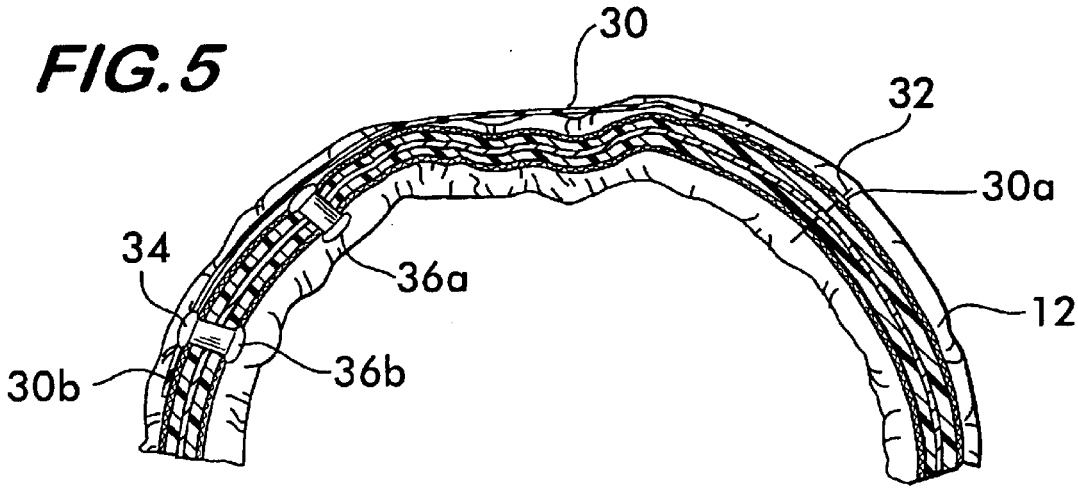
FIG. 5 is a sectional view similar to FIG. 4 except that the harness is shown adjusted to a reduced circumference.

Desirably, the peripheral extent of the harness 12 is adjustable circumferentially to accommodate the infant's girth. In the illustrated embodiment, the means for adjusting the harness 12 includes a pair of straps, or belts, 28 and 30, secured on opposite lateral sides of the harness 12 as best illustrated in FIG. 1. Preferably, each strap, 28 and 30, is made of an elastic material and is permanently secured to the harness via stitching 32 at one end, 28*a* and 30*a*, of each strap, 28 and 30. The opposite end, 28*b* and 30*b*, of each strap carries a series of metal or plastic snaps, push buttons, or the like 34 for being removably secured to the harness 12 at various locations along the periphery of the harness 12. To this end, complimentary snaps, grommets, or the like 36 are permanently secured within the harness 12 at various spaced-apart predetermined distances from stitching 32. Thus, the strap 30 can be secured to a first set of grommets 36*a* as shown in FIG. 4, or can be extended further about the periphery of the harness 12 and secured to a second set of grommets 36*b* as shown in FIG. 5 causing puckering of the harness 12 to take up excess material and to reduce the overall circumference of the harness 12. Other means for adjusting the circumference of the harness, such as adjustable belts, straps, etc. utilizing buttons, hook and loop fasteners, buckles, and the like can also be utilized.

In use, an infant is placed in the harness 12 which may, or not, also be adjusted circumferentially about the infant's waist or thorax for comfort purposes. The length of the straps 14, 16 is then adjusted by their respective buckles in order to dispose the bights 14*a*, 16*a* at a level which is comfortable for the adult to grasp with the infant's feet at the same floor level S as the adult. The adult can then support the infant while the adult stands and walks erect behind the infant to teach the infant to walk in front of the adult.

The described device has a number of advantages besides being comfortable to use by both the adult and infant. Among these are the fact that it can be laundered readily in a conventional washing machine and dried in a dryer. It can also be folded into a compact configuration for placement in a travel bag. It does not have any hardware such as handles, or the like, in proximity with the infant's torso or head that might cause injury if not used properly. Moreover, the device uses common materials which can be sewn readily and thereby manufactured economically.

While a preferred embodiment of the present invention has been described in detail, various modifications, alterations and changes may be made without departing from the spirit and scope of the present invention as defined in the appended claims.

What is claimed is:

1. A device for use by an adult to walk an infant while the adult is standing erect, comprising:

a padded torso harness for supporting an infant from locations below and around the infant's thorax;

at least one elastic strap carried on said harness and extending about a portion of a periphery of said harness for adjusting said periphery to accommodate the infant's girth, said at least one strap being releasably securable to said harness at alternate locations to cause puckering of said harness to take up excess material thereby reducing an overall circumference of said harness; and a pair of vertically-elongate, flexible, inverted U-shaped straps extending upwardly from the harness for providing a pair of bights grippable by the adult's hands while standing erect with both the adult's and the infant's feet on a common walking surface.

2. A device according to claim 1, wherein said pair of inverted U-shape straps consist essentially of a washable, flacid material connected to the harness so that the infant's shoulders extend horizontally through openings defined by the pair of inverted U-shaped straps.

3. A device according to claim 1, when said pair of inverted U-shaped straps are adjustable lengthwise to dispose their bights at selected elevations.

4. A device according to claim 1, wherein said padded torso harness includes waist webbing surrounding the infant's thorax, and crotch webbing connected to the thorax webbing for extending between the infant's legs.

5. A device according to claim 1, wherein said pair of inverted U-shaped straps extend upwardly from the harness at the thorax for a distance of about ⅔ the overall length of the device.

6. A device according to claim 1, wherein said at least one elastic strap includes a pair of opposed elastic straps located on opposite lateral sides of said harness.

7. A device according to claim 6, wherein one end of each of said opposed elastic straps is permanently secured to said harness and an opposite end has a fastener for being releasably secured to said harness at said alternate locations which are spaced-apart along the periphery of said harness.

8. A device according to claim 2, when said pair of inverted U-shape straps are adjustable lengthwise to dispose their bights at selected elevations.

9. A device according to claim 3, wherein said padded torso harness includes waist webbing surrounding the infant's thorax, and crotch webbing connected to the thorax webbing for extending between the infant's legs.

10. A device according to claim 9, wherein said pair of inverted U-shape straps extend upwardly from the harness at the thorax for a distance of about ⅔ the overall length of the device.

11. A device according to claim 10, wherein said least one elastic strap includes a pair of opposed elastic straps located on opposite lateral sides of said harness.

12. A device according to claim 11, wherein one end of each of said opposed elastic straps is permanently secured to said harness and an opposite end has a fastener for being releasably secured to said harness at said alternate locations which are spaced-apart along the periphery of said harness.

* * * * *